US005713752A

United States Patent [19]

Leong et al.

[11] Patent Number: 5,713,752

[45] Date of Patent: Feb. 3, 1998

[54] LATCHABLE ELECTRICAL CONNECTOR

[75] Inventors: Jackson Leong; T. C. Teo; S. C. Tan; Tan Khiang Meng; Ricky Tan; Adrian Huan, all of Singapore, Singapore

[73] Assignee: The Whitaker Corporation, Wilmington, Del.

[21] Appl. No.: 681,194

[22] Filed: Jul. 22, 1996

[30] Foreign Application Priority Data

Jul. 21, 1995 [SG] Singapore ..... 9500926

[51] Int. Cl.[6] ..... H01R 13/627

[52] U.S. Cl. ..... 439/358; 439/923

[58] Field of Search ..... 439/350–358, 439/923

[56] References Cited

U.S. PATENT DOCUMENTS

| | | | |
|---|---|---|---|
| 4,109,989 | 8/1978 | Snyder, Jr. et al. | 439/357 |
| 4,113,179 | 9/1978 | McKee | 439/354 |
| 4,526,431 | 7/1985 | Kasukawa | 439/353 |
| 4,699,438 | 10/1987 | Kikuta | 439/95 |
| 4,941,849 | 7/1990 | Fujiura | 439/610 |
| 5,197,895 | 3/1993 | Stupecky | 439/352 |
| 5,338,227 | 8/1994 | Nakamura | 439/352 |
| 5,383,794 | 1/1995 | Davis et al. | 439/352 |

FOREIGN PATENT DOCUMENTS

3/36043 4/1987 Japan .

*Primary Examiner*—Hien Vu

[57] ABSTRACT

Matable electrical connectors are protected against damage from excessive external force while they are reliably mated under normal conditions. One of the connectors 10 has a pair of latch devices 40*a* ,40*b* which are received in a pair of latch receiving recesses 23*a* ,23*b* in a connector housing 20. The latch devices 40 have resilient circular tongues 44 which are received in the recesses 23 with a controllable tensile force so that the latchable electrical connector 10 can be unmated from a matable connector 10' without manually unlatching the latch devices 40.

2 Claims, 4 Drawing Sheets

Fig. 1
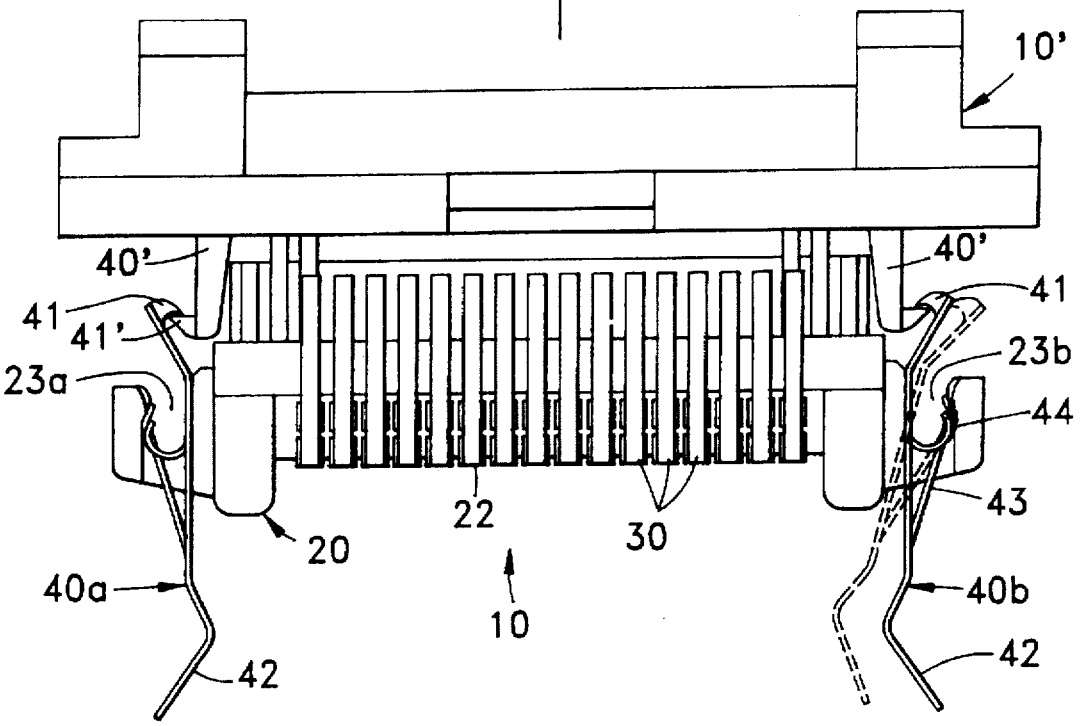
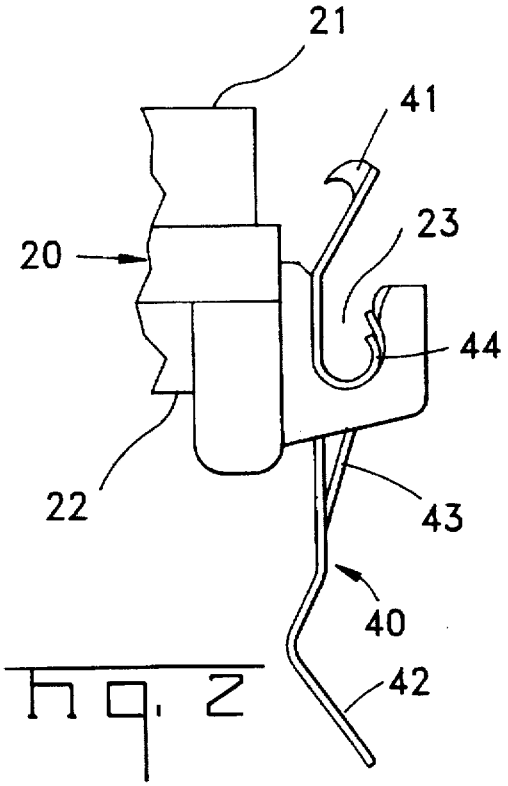
Fig. 2
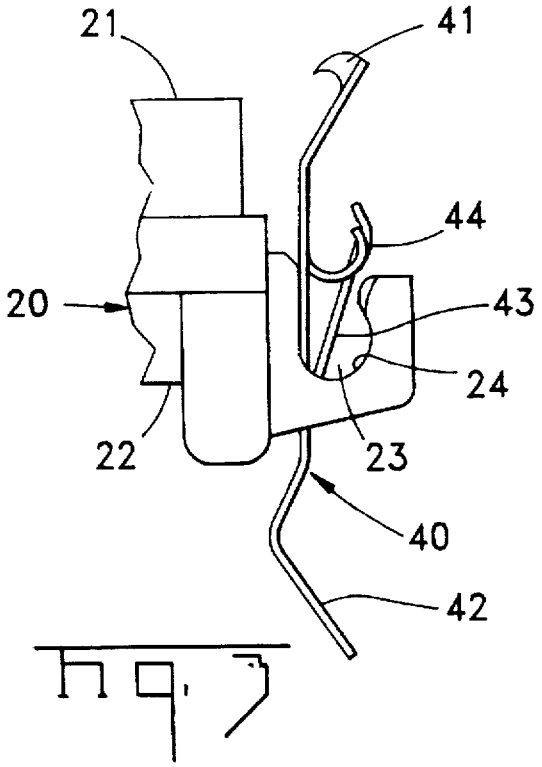
Fig. 3

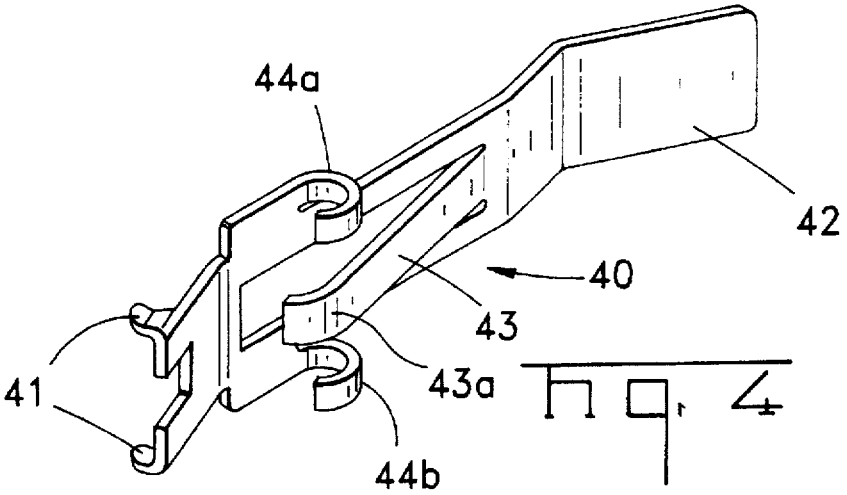
Fig. 4
Fig. 5
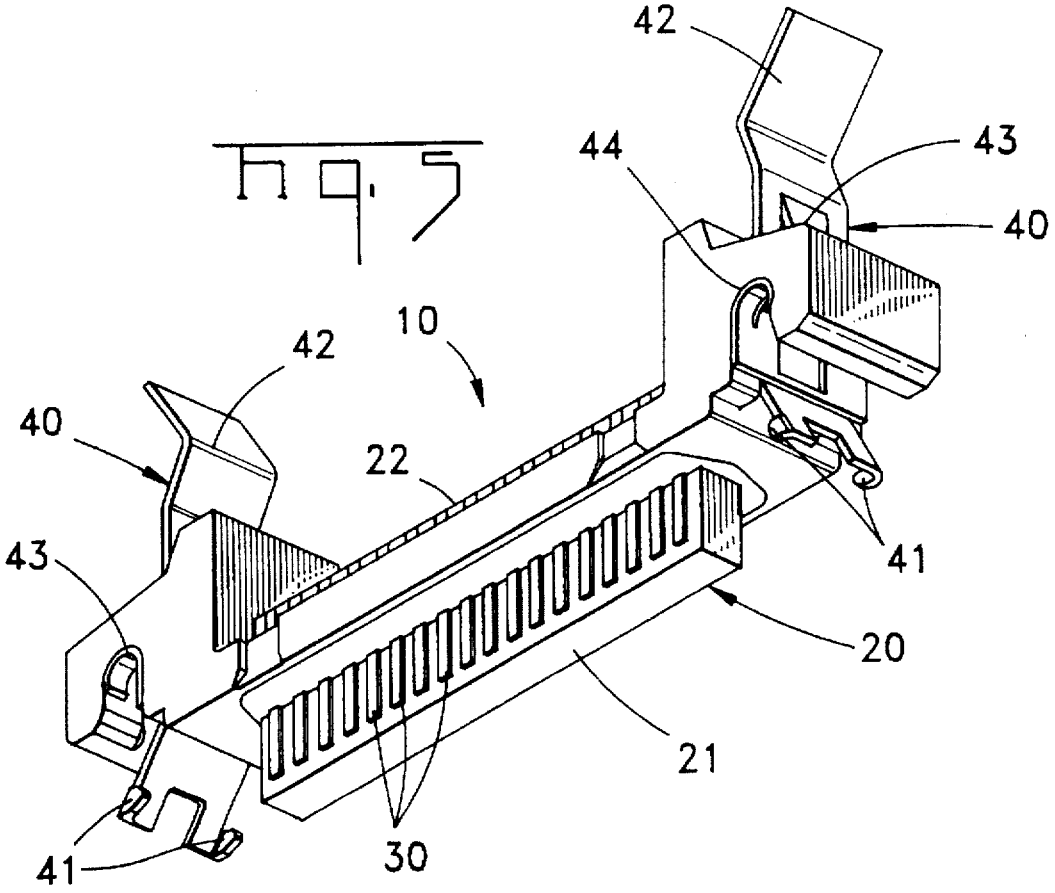

Fig. 6
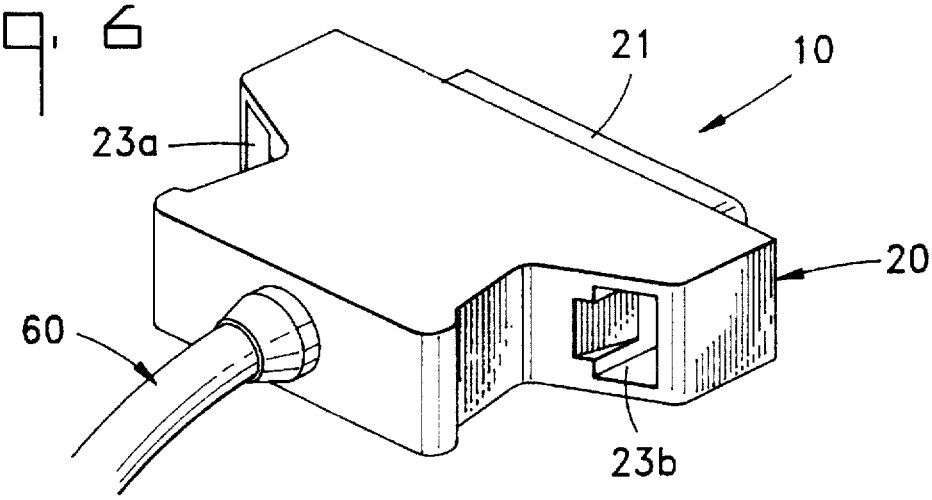
Fig. 7
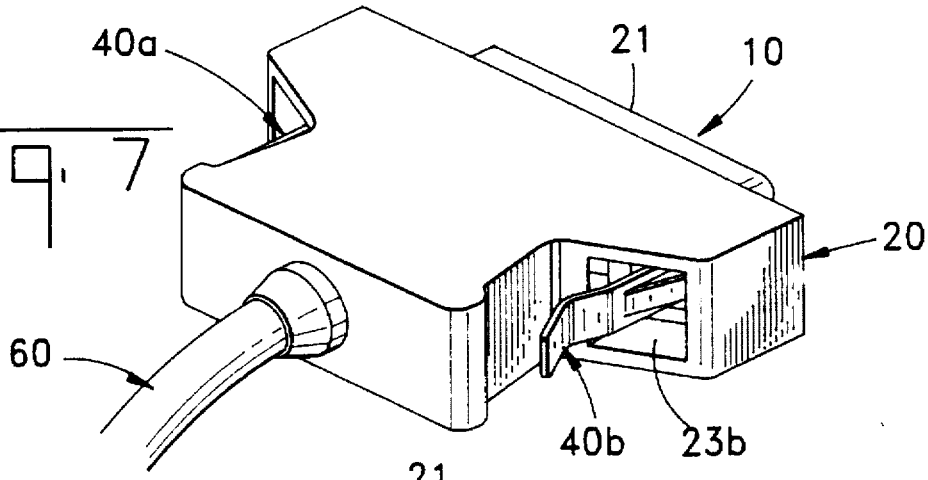
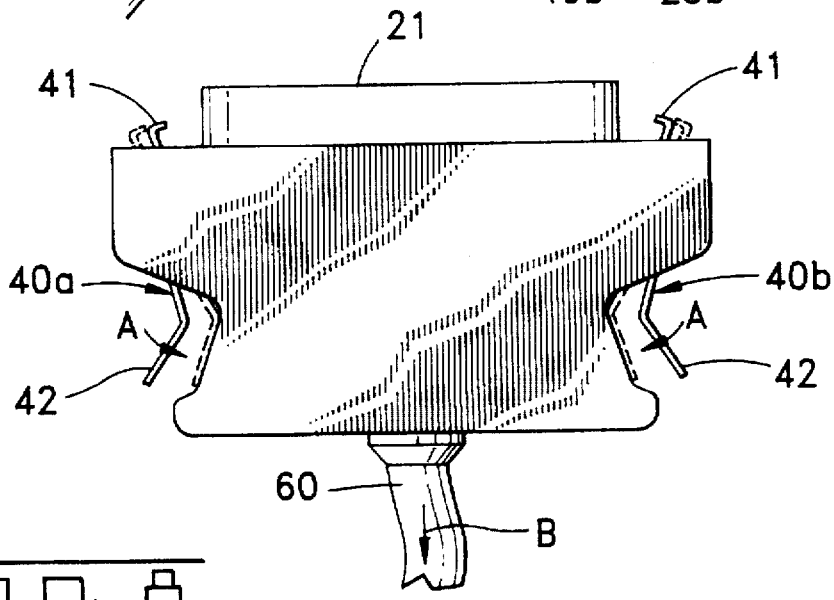
Fig. 8

LATCHABLE ELECTRICAL CONNECTOR

FIELD OF THE INVENTION

The invention relates to an electrical connector, and more specifically, to a latchable electrical connector for releasably latching an electrical connector to a matable connector.

BACKGROUND OF THE INVENTION

Various types of electrical connectors have been proposed and are in practical use for electrically interconnecting one or more electrical conductors through which signal, power or other electrical current is carried. The use of such electrical connectors provides improved design freedom and improved serviceability. More importantly, in electronic equipment like computers and electronic office equipment, the use of connectors is effective or absolutely required to set up a system including at least one each of computer, printer, external memory, etc.

In other words, one or more peripheral pieces of equipment is interconnected to a computer by using cable assemblies terminated to standardized electrical connectors, depending on particular applications. In an office, it is typical that many such pieces of equipment are interconnected using cable assemblies. Such electrical connectors are latched to complementary latch members of matable connectors of such equipment, thereby maintaining interconnection or mating of matable connectors.

Typical examples of such latchable electrical connectors are disclosed in Japanese patent publication no. 15595/92 and Japanese UM publication no. 36043/91 and U.S. Pat. Nos. 4,699,438 and 5,383,794. They are typically made of a resilient metal plate by a stamping and forming technique and comprise a hook at one end, an actuation lever at the other end, a fulcrum or pivot section and a resilient spring section. Such latches are pivotally retained in latch receiving recesses in a connector housing.

All of the above mentioned latchable electrical connectors are useful for releasably latching matable electrical connectors and maintain electrical interconnection between a large number of electrical contacts in such mated electrical connectors.

Unfortunately, since there are normally many cable assemblies interconnecting various electronic components in an office, for example, there are instances where operators or other persons may trip over the cables. As apparent from the above descriptions, electrical connectors at both ends of such cable are firmly latched to each other. Since some electronic components are relatively compact and lightweight, they may be pulled hard enough to fall off a table where they are placed, thereby damaging the sensitive and expensive electronic equipment or breaking the cables at the terminated portions. Such damages are larger and more time consuming than repairing the damages of, or recovering the data stored in, the computers and/or peripheral equipments.

SUMMARY OF THE INVENTION

It is, therefore, an object of the present invention to provide a latchable electrical connector capable of maintaining the mated electrical connectors in a reliable mated condition until an excessive external force is applied, thereby automatically unlatching an electrical connector from a matable connector before such damage may occur.

It is another object of the present invention to provide an improved latchable electrical connector capable of unlatching at a predetermined external force which is applied to the electrical connector.

In order to solve the problem associated with prior art latchable electrical connectors and achieve the aforementioned objects, the latchable electrical connector according to the present invention features the use of a pair of latch devices removably retained in a pair of latch receiving recesses until an excessive external force is applied thereto.

In one configuration of the latchable electrical connector, the latch devices are self-supported in the latch receiving recesses in the housing by resilient retention sections. In another configuration, a pair stuffer blocks are inserted into the latch receiving recesses for removably retaining the latch devices received in the latch receiving recesses.

In this particular construction of the latchable electrical connector, the electrical connector remains in mated condition with a matable connector but unmated therefrom when a damaging external force is applied. Subsequently, the latch devices may be reassembled with the connector housing after unmating of the electrical connector.

BRIEF DESCRIPTION OF THE DRAWINGS

The invention will now be described with reference to the accompanying drawings wherein:

FIG. 1 is a partial cross-section plan view of one embodiment of the latchable electrical connector in latched relationship with a matable connector.

FIG. 2 is an enlarged view of the latch device used on the latchable electrical connector in FIG. 1.

FIG. 3 shows the latch device in a removed, or extracted, condition.

FIG. 4 is a perspective view of the latch device used on the latchable electrical connector in FIG. 1.

FIG. 5 is a perspective view of the assembled latchable electrical connector in FIG. 1.

FIG. 6 is a perspective view of a connector housing without the latch device.

FIG. 7 is a perspective view of a fully assembled latchable electrical connector.

FIG. 8 is a plan view of the connector in FIG. 7, with movement of the latches being shown by phantom lines.

DETAILED DESCRIPTION OF THE PREFERRED EMBODIMENT

Figure 9:
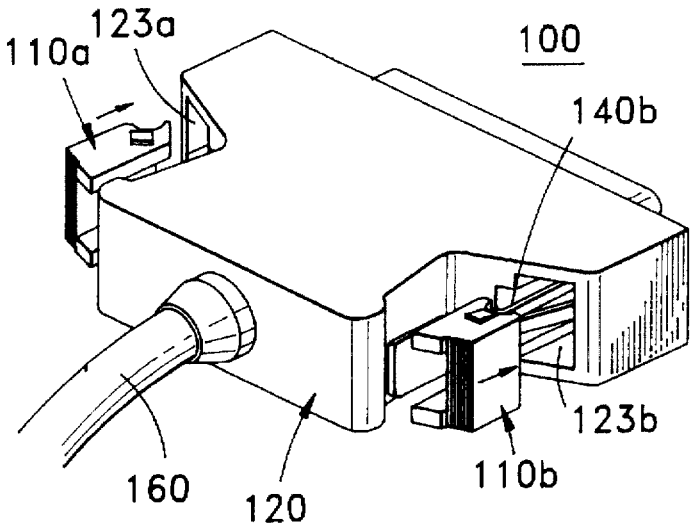
FIGS. 9 and 10 are perspective views of an alternative embodiment of the latchable electrical connector, showing stuffer blocks before and after full insertion, respectively, in the connector.

Illustrated in FIG. 1 is a cross section plan view of one preferred embodiment of the latchable electrical connector, along with a matable connector shown in phantom lines. The latchable electrical connector is represented generally by a reference numeral 10 and comprises a housing 20 made from any suitable insulating plastic material. Similar to any conventional electrical connector, the latchable electrical connector 10 includes a plurality of electrical contacts 30 received in a plurality of contact receiving cavities in the housing 20 extending from its mating face 21 to the rear face 22. Although not shown in FIG. 1, conductors or electrical wires in a cable 60 (see FIG. 6) are terminated to the contacts 30 by any conventional technique including soldering, welding, crimping, insulation displacing, etc.

The housing 20 has a pair of latch receiving recesses 23*a*, 23*b* at opposite ends or left and right ends in this particular embodiment. The latch receiving recesses 23*a*,23*b* are designed to receive a pair of latching devices 40*a*,40*b*.

A part of the housing 20 is shown in FIG. 2 and 3 in a magnified plan view along with one embodiment of the latch device 40. Also, illustrated in FIG. 3 is a perspective view of one example of the latch device 40. And shown in FIG. 5 is a perspective view of the latchable electrical connector 10 seen from the mating face 21 thereof.

Referring now to FIG. 4, one preferred embodiment of the latch device 40 is described in detail. The latch device 40 is an integral member made of a resilient material, preferably resilient metal such as stainless steel. Similar to a conventional design, the latch device (or latch arm) 40 includes a hook 41 at one end and an actuation section (or lever) 42 at the other end. Also, the latch device 40 has a cantilever spring section 43 made by stamping out the center part of the latch device 40. Additionally, the latch device 40 differs from any conventional design in the provision of retention sections or generally circular tongues 44*a*,44*b* formed at both sides of the cantilever spring section 43 adjacent to the free end 43*a* thereof.

As understood from FIGS. 1 through 5, the housing 20 has a pair of latch receiving recesses 23*a*,23*b* extending from one face to the other. Each latch device 40 is inserted into the respective latch receiving recess 23 from one face closer to the mating face 21 with the actuation section 42 leading. As best shown in FIG. 3, the housing 20 has an arcuate section 24 at the respective latch receiving recess 23 for resiliently receiving the circular tongues 44 when the latch device 40 is pressed therein with a sufficient force against the relatively strong resiliency of the circular tongues 44.

As best shown in FIG. 2 and 3, when the latch device 40 is fully inserted into the latch receiving recess 23 in the housing 20 (see FIG. 2 ), the latch device 40 is retained in the recess 23 with a certain strength predetermined by the shape and dimension of the arcuate section 24 and shape and resiliency of the circular tongues 44. Also, abutment of the spring section 43 of the latch device 40 against the outer wall of the receiving recess 23 normally biases the hook 41 in latching engagement with a complementary hook 41' of a matable connector 10'. On the other hand, when an excessive external force is applied to the latchable electrical connector 10, the latch device 40 comes out of the latch receiving recess 23 as long as the tensile force exceeds the engagement force between the circular tongues 44 and the arcuate section 24 in the latch receiving recess 23 as best shown in FIG. 3. Note that the hooks 41,41' remain engaged and the latch device 40 is not damaged, thereby making it possible to recover or reassemble the latch devices 40 into the latch receiving recesses 23 before mating the latchable electrical connector 10 again with the matable connector 10'.

When the actuation section 42 of the latch device is depressed inwardly, as shown by a broken line in FIG. 1, the hook 41 at the front end moves away from the hook 41' of the matable connector 10', thereby unlocking the connectors 10,10' to enable them to unmate for maintenance or other purposes.

Now, the operation and/or assembly of the latchable electrical connector 10 will be described again by reference to FIGS. 6 thru 8. As shown in FIG. 6, the connector housing 20 has a pair of latch receiving recesses 23*a*,23*b* at opposed end portions. A pair of latch devices 40*a*,40*b* are inserted into the latch receiving recesses 23 by using a suitable hand tool (not shown), such as a pair of pliers, as shown in FIG. 7. After full insertion of the latch devices 40*a*,40*b* into the respective recesses 23*a*,23*b* in the housing 20, the actuation sections 42 of the latch devices 40 are actuated toward each other by operator's fingers as shown by arrows A in FIG. 8. The hooks 41 at the front (mating) ends of the connector housing 20 move laterally, thereby allowing the latchable electrical connector 10 to lock or unlock the complementary but stationary latches 40' of the matable connector 10'. An external force may be applied to the cable 60 in the direction shown by an arrow B.

Figure 10:
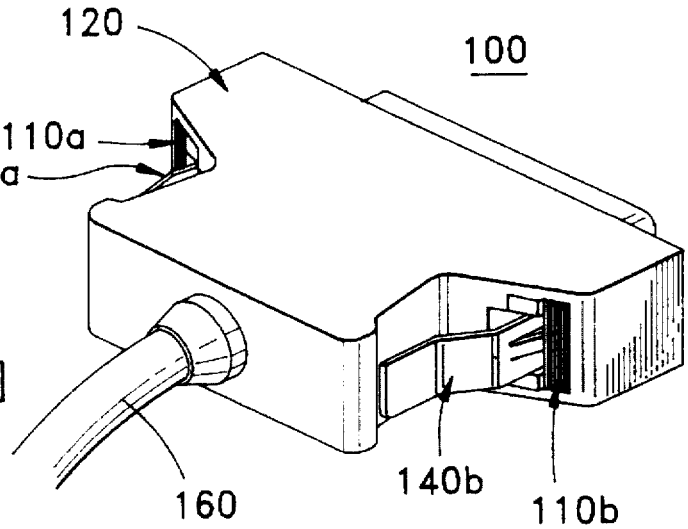
Figure 11:
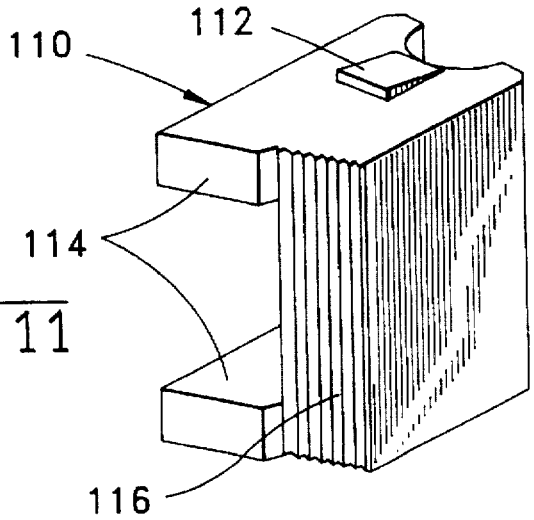
FIG. 11 is a perspective view of the stuffer block in FIG. 9.

Now, illustrated in FIGS. 9 and 10 are perspective views of another embodiment of the latchable electrical connector 100 according to the present invention. The latchable electrical connector 100 is similar to the above embodiment or the latchable electrical connector 10 but differs in that a pair of stuffer blocks 110*a*, 110*b* are inserted into a pair of latch receiving recesses 123*a*,123*b* in a housing 120. As best shown in FIG. 11 in a perspective view, each stuffer block 110*a*,110*b* is preferably made of the same plastic material as the housing 120. The stuffer block 110 is formed with a pair of wedges 112 on both ends for firmly securing the stuffer block 110 in the latch receiving recess 123. In this configuration, the latch receiving recesses 123 in the housing 120 may be through holes and the stuffer blocks 110 act to back up the latch devices 140*a*,140*b* inserted into the latch receiving recesses 123 from the rear face toward the mating (front) face of the housing 120.

Also, the stuffer block 110 is formed with a guide rail 114 to receive the latch device 140. When the stuffer block 110 is inserted into the latch receiving recess 123, it pushes the circular tongue of the latch device 140 to seat it at a predetermined position. The guide rail 114 is sloped to provide a clearance for the latch device 140 to rotate or pivot. A plurality of serrations 116 are formed at the rear end of the stuffer block 110 for ease of insertion thereof in the latch receiving recess 123.

Although only preferred embodiments of the latchable electrical connector have been described in detail hereinabove, it will be appreciated that various modifications can be made without departing from the scope and spirit of the present invention. For example, the housing is preferably covered with a shielding metal plate at the mating face for EMI protection purposes. The housing may be a generally vertical type having one or more rows of contacts disposed in vertical direction. In such an instance, the latch devices may be provided at both top and bottom end portions. Needless to say that the housing may take other configurations best fit to particular applications.

Also, the latch device may take any other configurations. For example, the actuation section of the latch device may be relatively flat and may have an insulation cover so long as such insulation cover is relatively small to pass through the latch receiving recess 23 in the housing 20 when an excessive external force is applied. The spring section and the circular tongues may be exchanged, i.e., a pair of cantilever spring sections are formed at both sides of a single circular tongue at the center part of the latch device.

As understood from the above description and the drawings, important advantages of this invention include the capability of disconnecting or unlatching mated electrical connectors before damaging the connectors or any electronic equipment using such connectors by excessive external force while maintaining the latched or mated condition of such connectors under normal operation. Subsequently, the latch devices may be reassembled with the connector housing by simply inserting them, thereby recovering the latchable electrical connector without causing any damage. The critical level of force in which the latch devices slip off the latch receiving recesses can be controlled by proper choice of the resiliency and shape of the circular tongues and the arcuate sections in the latch receiving recesses in the housing.

We claim:

1. A latchable electrical connector having a pair of latch devices received in a pair of latch receiving recesses at opposite ends of a housing for releasably latching the electrical connector to a matable connector, characterized in that:

each of said latch devices is an integral member made of resilient material and has a retention section which resiliently retains said latch device in said latch receiving recess, whereby when an excessive external force is applied to the electrical connector said latch devices are caused to withdraw from said latch receiving recesses, thereby permitting separation of said electrical connector from said matable connector while said latch devices remain latched to said matable connector.

2. A latchable electrical connector having a pair of resilient latch devices received in a pair of latch receiving recesses at opposite ends of a housing for releasably latching the electrical connector to a matable connector, characterized in that:

a pair of stuffer blocks are firmly held in said latch receiving recesses in said housing, and said resilient latch devices are resiliently engaged by said stuffer blocks for resiliently retaining said latch devices in said latch receiving recesses, whereby when an excessive external force is applied to the electrical connector said latch devices are caused to withdraw from said latch receiving recesses, thereby permitting separation of said electrical connector from said matable connector while said latch devices remain latched to said matable connector.

* * * * *